US010543502B2

(12) United States Patent
Williams

(10) Patent No.: US 10,543,502 B2
(45) Date of Patent: Jan. 28, 2020

(54) WORK PIECE PROCESSING ARRANGEMENTS

(71) Applicant: SPRAYBOOTH TECHNOLOGY LIMITED, Sudbury, Suffolk (GB)

(72) Inventor: Michael Williams, Sudbury (GB)

(73) Assignee: SPRAYBOOTH TECHNOLOGY LIMITED, Sudbury, Suffolk (GB)

( * ) Notice: Subject to any disclaimer, the term of this patent is extended or adjusted under 35 U.S.C. 154(b) by 490 days.

(21) Appl. No.: 15/515,853

(22) PCT Filed: Oct. 30, 2015

(86) PCT No.: PCT/GB2015/053264

§ 371 (c)(1),
(2) Date: Mar. 30, 2017

(87) PCT Pub. No.: WO2016/071672

PCT Pub. Date: May 12, 2016

(65) Prior Publication Data

US 2017/0304860 A1 Oct. 26, 2017

(30) Foreign Application Priority Data

Nov. 6, 2014 (GB) ..... 1419805.5

(51) Int. Cl.
*D04H 1/46* (2012.01)
*B05B 14/43* (2018.01)
(Continued)

(52) U.S. Cl.
CPC ..... *B05B 14/43* (2018.02); *B05B 16/60* (2018.02); *B05B 16/90* (2018.02); *B05D 3/0209* (2013.01);
(Continued)

(58) Field of Classification Search
CPC ..... B05B 14/43; B05B 16/60; B05B 16/90; B05B 16/40; B05B 12/18; B05B 15/00;
(Continued)

(56) References Cited

U.S. PATENT DOCUMENTS

2007/0026754 A1* 2/2007 Martin Rivera ..... A47L 17/08 442/402
2016/0084573 A1* 3/2016 Sugar ..... F26B 3/28 432/29

* cited by examiner

*Primary Examiner* — Helena Kosanovic
(74) *Attorney, Agent, or Firm* — Mossman, Kumar & Tyler, PC

(57) ABSTRACT

A workpiece processing arrangement comprises a spray booth (2) defining a work space (21), and operable to provide a controlled environment for spraying of material, a first oven (4) located adjacent a first end of the spray booth, the first oven defining an internal zone, and a second oven (5) located adjacent a second end of the spray booth, the second oven defining an internal zone (51). The arrangement also includes a transport rail (6) which extends from the internal zone (41) of the first oven (4), through the work space (21) of the spray booth (2) into the internal zone (51) of the second oven (5), the transport rail (6) being adapted for transport of a workpiece (10) between the work space (21) of the spray booth (2) to the internal zone of the first or second oven (4, 5). A corresponding method of processing a work piece in such an arrangement indicates the steps to be used when processing a first and a second workpiece The ovens may have both a baking and a curing zone. A ventilation system with an air curtain (23) may be included.

18 Claims, 9 Drawing Sheets

(51) Int. Cl.

| | |
|---|---|
| ***B05D 3/02*** | (2006.01) |
| ***B05B 16/60*** | (2018.01) |
| ***B05B 16/00*** | (2018.01) |
| ***F24F 3/16*** | (2006.01) |
| ***F24F 7/007*** | (2006.01) |
| ***F26B 25/00*** | (2006.01) |
| *B05B 16/40* | (2018.01) |
| *B05B 12/18* | (2018.01) |
| *B05B 15/00* | (2018.01) |
| *F23J 11/00* | (2006.01) |
| *F24F 7/00* | (2006.01) |

(52) U.S. Cl.
CPC ..... *B05D 3/0272* (2013.01); *F24F 3/1603* (2013.01); *F24F 7/007* (2013.01); *F26B 25/003* (2013.01); *B05B 12/18* (2018.02); *B05B 15/00* (2013.01); *B05B 16/40* (2018.02); *F23J 11/00* (2013.01); *F24F 7/00* (2013.01)

(58) Field of Classification Search
CPC ... B05D 3/0209; B05D 3/0272; F24F 3/1603; F24F 7/007; F24F 7/00; F26B 25/003; F23J 11/00
USPC ..... 442/402, 417, 405; 118/620
See application file for complete search history.

WORK PIECE PROCESSING ARRANGEMENTS

The present invention relates to workpiece processing arrangements.

BACKGROUND OF THE INVENTION

There are many industrial processes in which work pieces (components or parts) are surface treated, for example painted or powder coated.

A spray booth is a structure that provides a ventilated, air filtered and temperature controlled environment in which spraying activities such as painting and powder coating can take place. A spray booth is necessary for the safe execution of such activities, since the sprayed materials include solvents and particulate material that must not enter the atmosphere in large quantities. The particulate material that does not stick to the article being sprayed must be removed from the spraying area to ensure safe working conditions, and to manage environmental impact.

A spray booth also provides a controlled supply of filtered air that aids the spraying process and leads to higher quality finishes. In addition, it is necessary to heat sprayed materials in order to dry them (in a process known as baking), and a spray booth typically provides a controlled temperature environment in which such baking can be undertaken.

In the automotive sector, a body shop which repairs and repaints cars and other vehicles may have the need to prepare and spray small components, such as wheels. Using a spray booth designed for spraying of whole vehicles is wasteful in several respects; the energy requirements for the booth are high, relative to the objects being sprayed, the size of the booth significantly exceeds that required for the smaller objects, and the use of a full booth for smaller jobs creates organizational issues for the spray booth operator.

Accordingly, it is desirable to provide a spray booth arrangement that is tailored for smaller objects, in order to enable higher efficiency in processing of those smaller objects, whilst providing the required controlled environments for spraying and finishing at a reasonable cost.

SUMMARY OF THE INVENTION

According to a first aspect of the present invention, there is provided a workpiece processing arrangement comprising a spray booth defining a work space, and operable to provide a controlled environment for spraying of material, a first oven located adjacent a first end of the work space, the first oven defining an internal zone, and being operable to heat that internal zone to a desired temperature, a second oven located adjacent a second end of the work space, the second oven defining an internal zone, and being operable to heat that internal zone to a desired temperature, and a transport rail which extends from the internal zone of the first oven, through the work space of the spray booth into the internal zone of the second oven, the transport rail being adapted for transport of a workpiece from the work space of the spray booth to the internal zone of each of the first and second ovens and into the work space from the internal zone of each of the first and second ovens.

In one example, the spray booth comprises a roof portion, a side portion which extends from the roof portion to a floor, first and second end portions which extend from respective opposing ends of the roof portion to the floor, the roof portion, side portion and first and second end portions thereby defining the work space having a substantially closed side, a pair of substantially closed ends, and a side substantially open to the outside of the booth, the work space including a work zone in which an operative is located during use of the spray booth, and a spraying region in which a workpiece is located during spraying thereof, air input equipment operable to provide an input airflow at an input volume flow rate into the work space via the roof portion, and air extraction equipment operable to extract output airflow at an output volume flow rate from the work space.

The input volume flow rate may be greater than the output volume flow rate. For example, the input volume flow rate is at least twice the output volume flow rate.

In one example, the roof portion defines a plenum into which the airflow is supplied. In one example, the air input equipment comprises a fan unit mounted on the roof portion.

The air extraction equipment may comprise an extraction aperture located in the side portion, a fan unit located outside of the workspace, extraction ducting extending from the extraction aperture to the fan unit, and an extraction filter.

Such an example may also comprise an air outlet connected with the fan unit, and arranged for connection to an air outlet chimney. In one example, the first oven defines a baking zone and a curing zone in the internal zone of the oven, the first oven being operable to heat the baking zone to a baking temperature, and to heat the curing zone to a curing temperature, the baking temperature being higher than the curing temperature. The baking zone may be located above the curing zone. In a particular example, the first oven defines a first aperture for access into the baking zone, and a second aperture for access into the curing zone, the first and second apertures being provided with respective doors for selective closure thereof.

According to a second aspect of the present invention, there is provided a method of processing a work piece in a workpiece processing arrangement comprising a spray booth defining a work space, and operable to provide a controlled environment for spraying of material, a first oven located adjacent a first end of the work space, the first oven defining an internal zone, and being operable to heat that internal zone to a desired temperature, a second oven located adjacent a second end of the work space, the second oven defining an internal zone, and being operable to heat that internal zone to a desired temperature, and a transport rail which extends from the internal zone of the first oven, through the work space of the spray booth into the internal zone of the second oven, the transport rail being adapted for transport of a workpiece from the work space of the spray booth to the internal zone of each of the first and second ovens, and into the work space from the internal zone of each of the first and second ovens, the method comprising, locating a first workpiece in the work space of the spray booth, performing an operation on the first workpiece, moving the first workpiece to the internal zone of the first oven using the transport rail, locating a second workpiece in the work space of the spray booth, performing an operation on the second workpiece, moving the second workpiece to the internal zone of the second oven using the transport rail, moving the first workpiece from the first oven to the work space of the spray booth using the transport rail, removing the first workpiece from the work space of the spray booth, moving the second workpiece from the second oven to the work space of the spray booth using the transport rail, and removing the second workpiece from the work space of the spray booth.

DETAILED DESCRIPTION OF THE PREFERRED EMBODIMENTS

Figure 1:
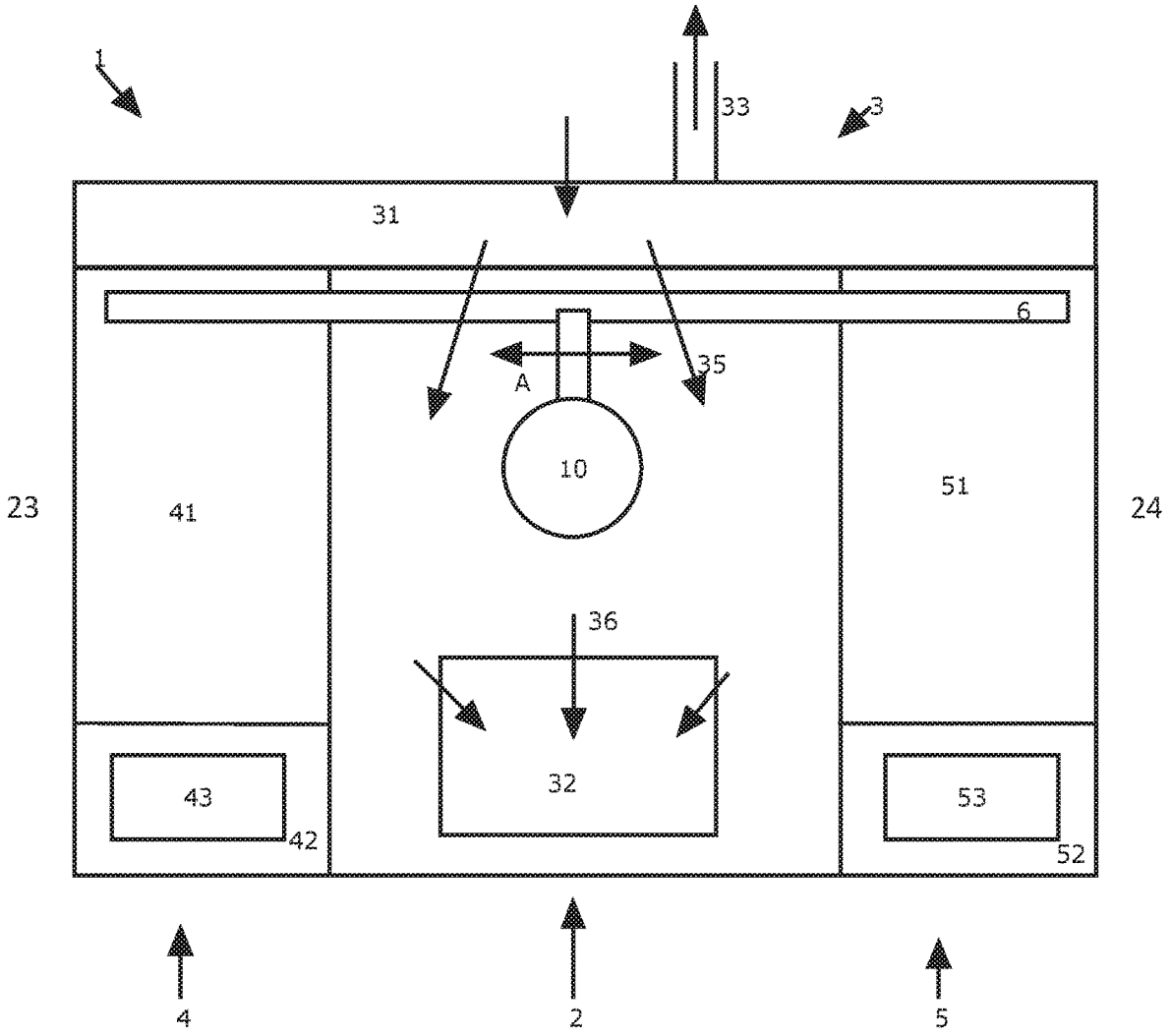
FIG. 1 is a schematic side view of a spray booth arrangement embodying aspects of the present invention.

FIG. 1 illustrates a spray booth arrangement embodying various aspects of the present invention. The arrangement 1 comprises a centrally located work space 2, with first and second ovens 4 and 5 to respective sides of the work space 2. Air handling plant 3 provides clean air input into, and air extraction out of, the work space 2. A workpiece transfer rail 6 extends between the work space 2 and the first and second ovens 4 and 5, and is used to transfer a workpiece 10 between those areas, as will be described in more detail below.

The air handling plant 3 comprises an air inlet region 31, which provides air 35 into the work space 2, and an air extraction filter 32 through which air 36 is extracted from the spray booth zone 2.

The ovens 4 and 5 each incorporate a high temperature baking zone 41, 51, and a lower temperature curing zone 42, 52. Each oven 4, 5 is provided with a door 43, 53 to enable access to the curing zone 42, 52.

Figure 2:
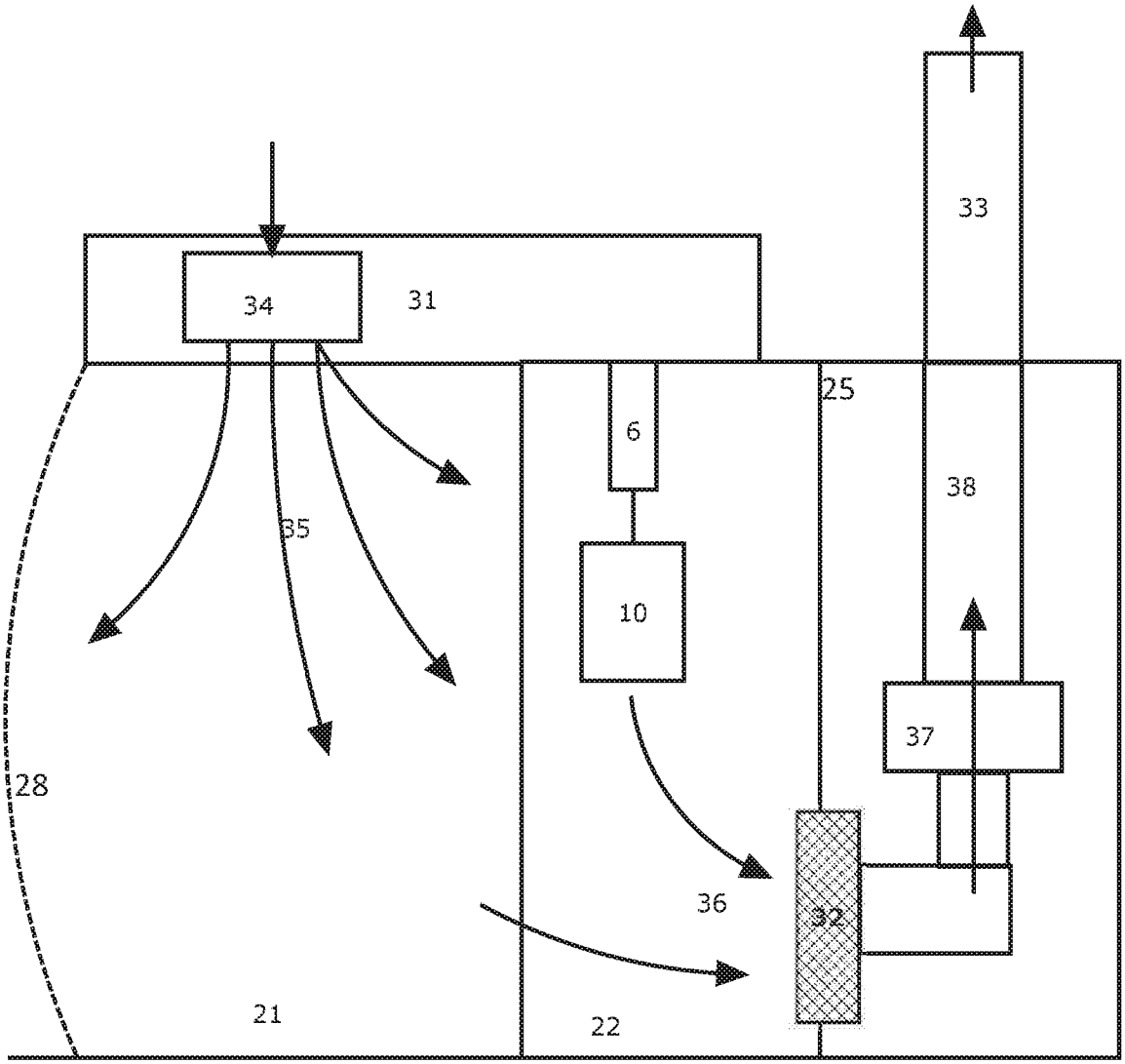
FIG. 2 is a schematic cross-sectional view of the spray booth arrangement of FIG. 1.

FIG. 2 is a schematic side cross sectional view of the spray booth zone 2 of the spray booth arrangement of FIG. 1. The work space zone 2 has two regions—a work zone 21 (which extends in front of the two ovens 4 and 5), in which an operative is located during use of the booth, and a spraying region 22, in which a workpiece 10 is located during spraying thereof.

The work space 2 is provided with air handling plant 3 which is operable to provide clean air input into the work space 2, and to extract contaminated air from the work space 2, and in particular from the spraying region 22.

The air handling plant 3 comprises an inlet fan 34 which draws clean air in from outside of the spray booth and passes this clean air into an inlet plenum 31 which extends across the ceiling area of the spray booth work zone 21. The inlet fan 34 preferably includes an air filter or filters in order that the air input into the work space 2 is cleaned to a required standard.

An air extraction port 32 is provided in a side wall 25 of the spraying region 22. An air extraction fan 37 draws air 36 through the extraction port 32, through ducting 38, and causes the air to be expelled from the spray booth arrangement 1 via a chimney 33. The extraction port 32, the extraction fan 37 and/or the ducting 38 preferably includes one or more filter elements for removal of contaminants from the extracted air before release from the arrangement 1. In many installations it is required that the air being expelled from the arrangement has a significantly reduced level of contamination, and so suitable filtration may be provided in the extraction part of the air handling plant 3.

The transfer rail 6 extends through the spraying region 22, such that a workpiece 10 can be sprayed and worked on in a filtered controlled air environment. A worker (not shown for clarity) is able to spray the workpiece 10 as it is suspended from the transfer rail 6 in the spraying region 22 from the work zone 21. Any appropriate spraying process may be carried out in the spraying area, for example spraying of water or other liquid based paints, or powder coating in which dry particulate material is sprayed onto the workpiece 10.

Figure 3:
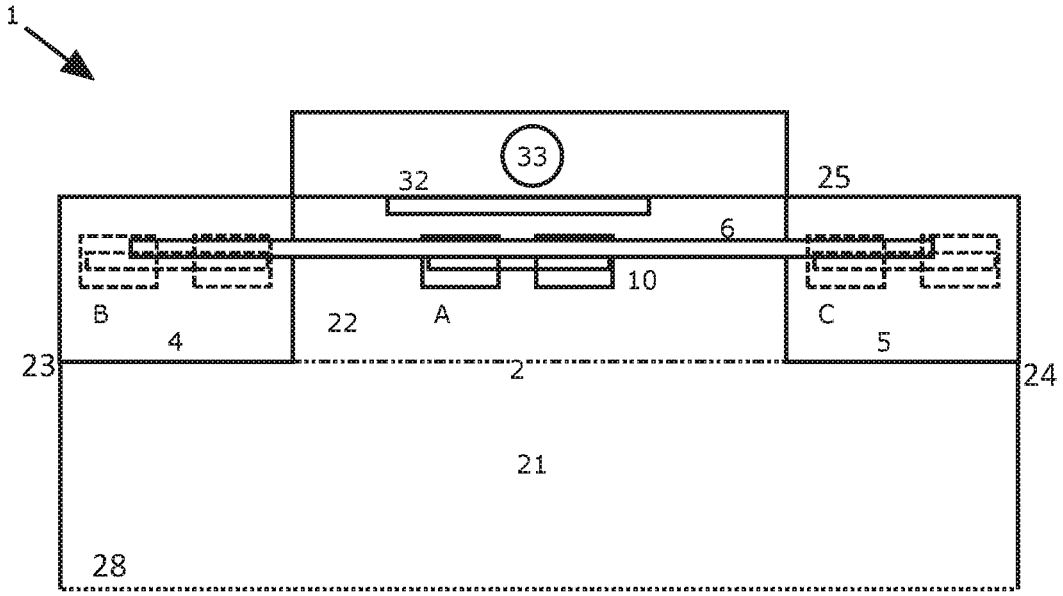
FIG. 3 is a schematic plan view of the spray booth arrangement of FIG. 1.

FIG. 3 is a schematic plan view of the spray booth arrangement 1 of FIGS. 1 and 2. As can be seen more clearly from FIG. 3, the spray booth arrangement 1 is bounded by end walls 23 and 24, and by a side wall 25. A roof portion extends over the arrangement 1. The work space 2 is located in a central region of the arrangement 1 and includes the work zone 21 and the spraying zone 22. As described above, the work space 2 is bounded at each end by an oven 4, 5. Each oven defines a self-contained volume, separated from rest of the spray booth arrangement 1 by way of insulated walls. Each oven includes a sliding door to enable a workpiece to be moved into and out of the oven from the spraying region 22 of the work space 2 using the rail 6. In FIG. 3, the work piece 10 is shown in a spraying position (A), and can be moved to the first oven 4 (position B) or to the second oven 5 (position C). More detailed description of the ovens and the overall operation of the arrangement is set out below.

The spray booth arrangement shown in FIGS. 1, 2 and 3 has an open side opposite to the spraying zone 22 and ovens 4 and 5. This open side enables work pieces to be transferred into and out of the spray booth arrangement 1 with ease and high efficiency. However, having such an open side may cause problems with the cleanliness of the air within the work space 2.

Accordingly, in an embodiment of one aspect of the present invention, the flow rate of clean air input to the work space 2 is higher than the rate of extraction of air from the spraying zone 22 of the work space 2. In one preferred example, the flow of air into the work space 2 is approximately twice the flow rate of air extracted through the extraction port 32. For example, the input flow rate may be approximately 30000 $m^3$/hr with the extraction rate of approximately 15000 $m^3$/hr. This difference in flow rates results in a flow of clean air out of the open side of the spray booth arrangement 1, which provides an air curtain 28. This air curtain 28 provides a barrier that serves to prevent ingress of contaminants from outside of the spray booth arrangement 1 through the open side thereof. The extraction flow rate is chosen such that all, or substantially all, of the contaminated air from the spraying region 22 is removed from the work space zone 2, without reaching the work region 21. In this way, any release of contaminated air can be closely controlled.

Figure 4:
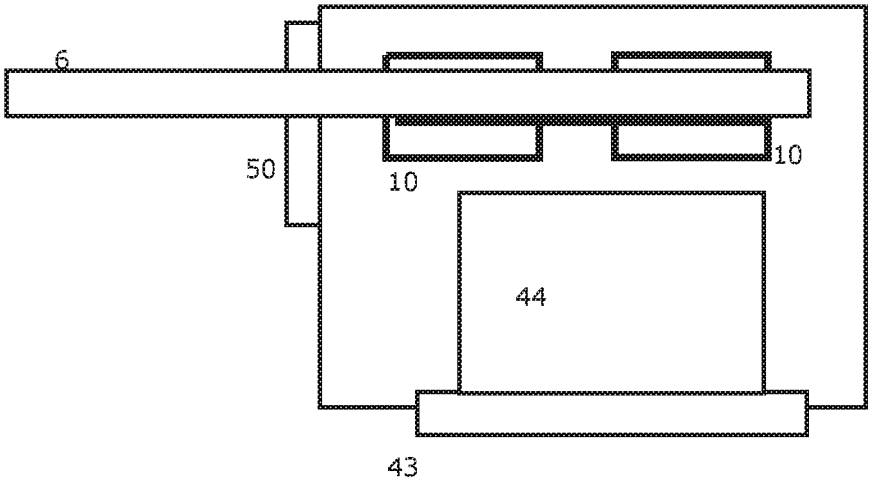
FIG. 4 is a schematic plan view of an oven component of the spray booth arrangement of FIG. 1.
Figure 5:
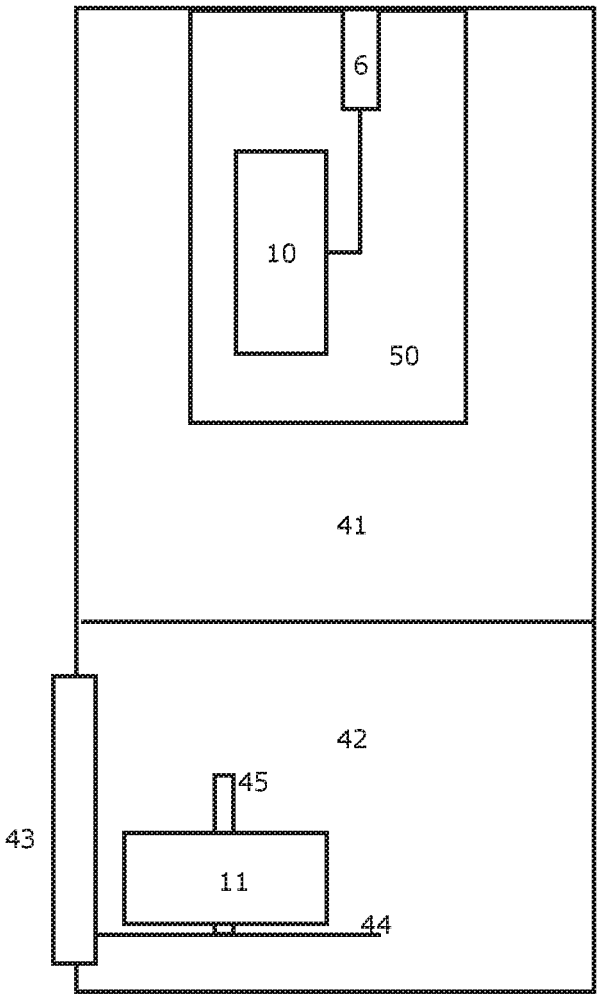
FIG. 5 is a schematic cross-sectional side view of the oven component of FIG. 4.

FIGS. 4 and 5 are schematic cross sectional plan and end views respectively of the first oven 4. It will be readily appreciated that the second oven 5 is preferably identical in construction and arrangement to the first oven 4.

In accordance with another aspect of the present invention, the oven 4 defines a high temperature baking zone 41, and a lower temperature curing zone 42. The baking zone 41 is arranged above the curing zone, and operates at a temperature higher than that of the curing zone. The transport rail 6 extends into the baking zone 41. An opening in a side wall 30 of the baking zone 41 is provided, and is positioned such that a workpiece 10 can be moved into and out of the baking zone 41 using the transport rail 6. A sliding door 50 is used to selectively close the opening into the baking zone 41 of the oven 4.

In addition, the oven 4 is provided with a lower door 43 to enable access thereto from the work space 21. The lower door 43 is combined with a workpiece support 44, which is attached to the lower door 43, and which extends into the curing zone 42 when the lower door 43 is closed. The workpiece support 44 may be provided with an upstand 45 on which a workpiece 11 is supported. Operation of the lower door 43 and workpiece support 44 will described below with reference to FIGS. 6 and 7.

Figure 6:
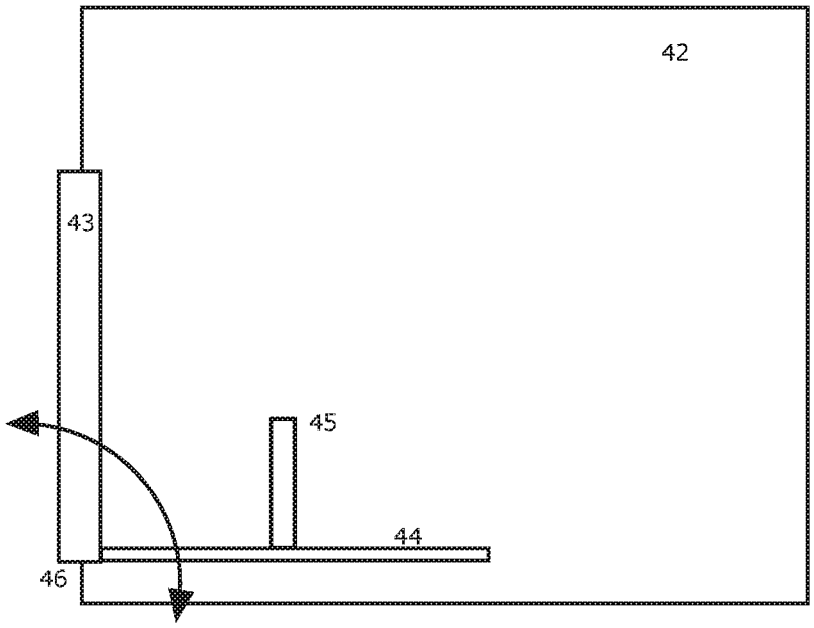
FIG. 6 is a schematic cross-sectional view of the component of FIGS. 4 and 5 in a closed.
Figure 7:
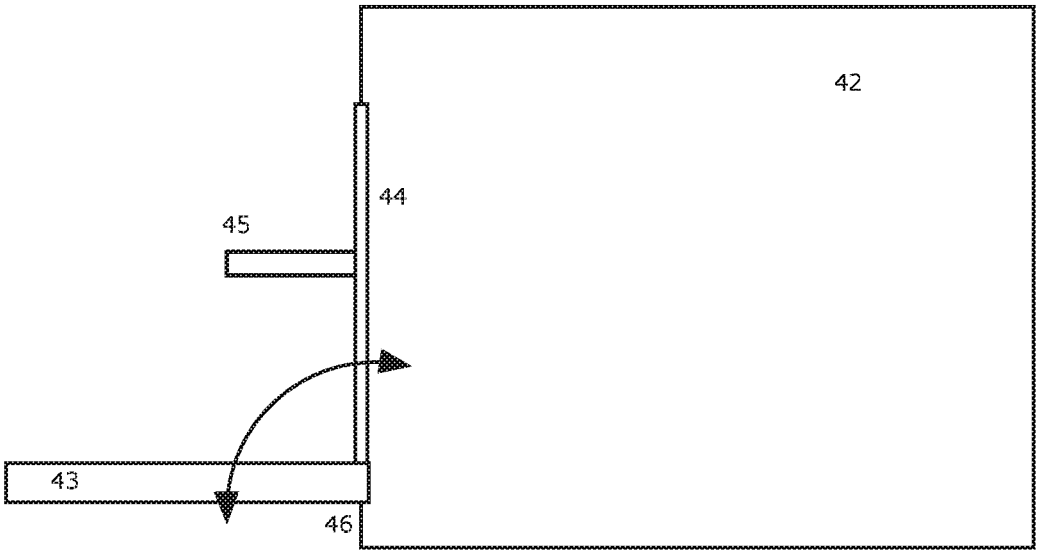
FIG. 7 is a schematic cross-sectional view of the component of FIGS. 4 and 5 in an open configuration.

FIGS. 6 and 7 illustrate the curing zone of the oven 4, 5 in closed and open configurations respectively. The lower door 43 is rotatably attached to the oven structure by way of a pivotable hinge 46. The workpiece support 44 is attached to the lower door 43 and extends into the curing zone 42 from the lower door 43. The lower door is movable between the closed (FIG. 6) configuration, and open (FIG. 7) configuration by rotating the lower door 43 about the hinge 46, as shown by arrow 47 in FIGS. 6 and 7. When the oven door is in the open position as shown in FIG. 7, the curing zone of the oven is closed, thereby reducing heat loss from the oven. In addition, the workpiece support 44 and upstand 45 are available to the operator for location or removal of the workpiece (not shown for clarity in FIG. 7).

Figure 8:
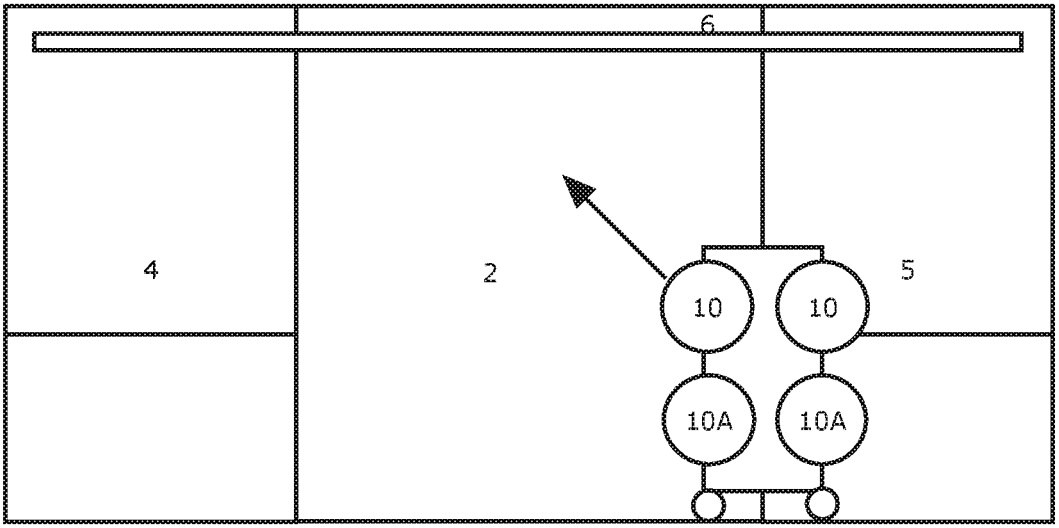
FIGS. 8 to 14 are schematic views illustrating operation of the arrangement of FIGS. 1 to 7.

Processing of workpieces will now be described with reference to the schematic views of FIGS. 8 to 14. At a first stage of the process, a number of workpieces 10, 10A are delivered to the workspace, preferably on a wheeled trolley (FIG. 8). In the present example, the workpieces are vehicle wheels, which are process in pairs. An important application of the arrangement and process described herein is to the refurbishment of wheels for cars, which are most commonly processed in two pairs. It will be readily appreciated that the principles of operation described herein are applicable to any type and number of workpieces.

Figure 9:
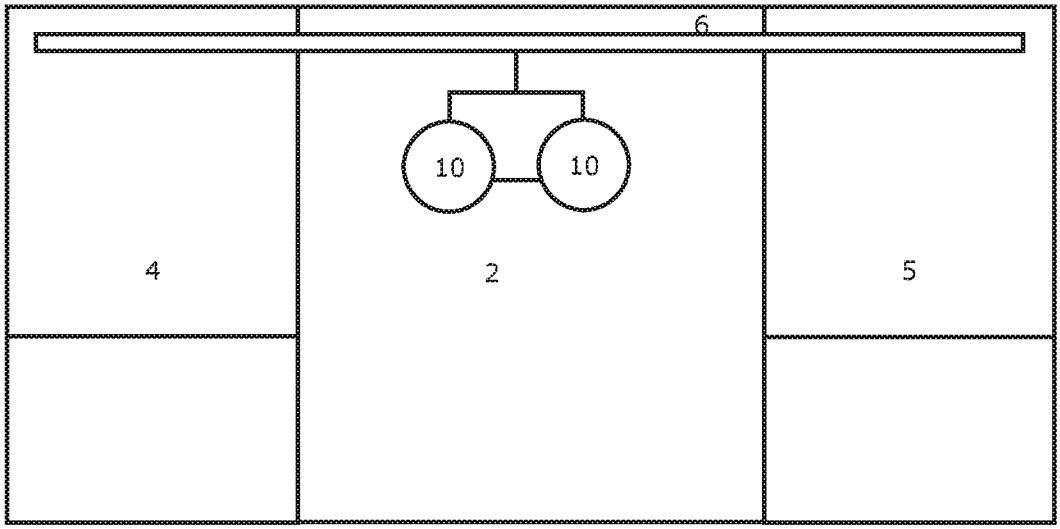

A first pair of wheels 10 is loaded onto a frame on the transport rail 6 in the spraying zone 22 (FIG. 9). The frame may be provided as a removable part of the trolley on which the wheels 10 are delivered, or may be separate from the trolley. The trolley carrying the second pair of wheels 10A is not shown in FIG. 9 for the sake of clarity. The operator is then able to undertake a spraying operation, be that paint spraying or powder coating, while the wheels are in the spraying zone 22. During this operation, the air handling equipment described above is providing a clean air environment in the work space 2.

Figure 10:
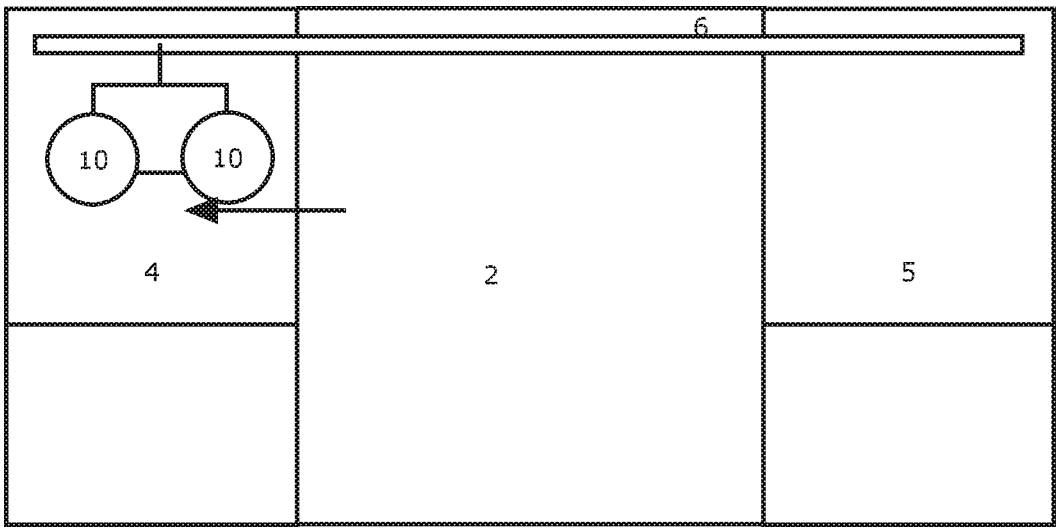
Figure 11:
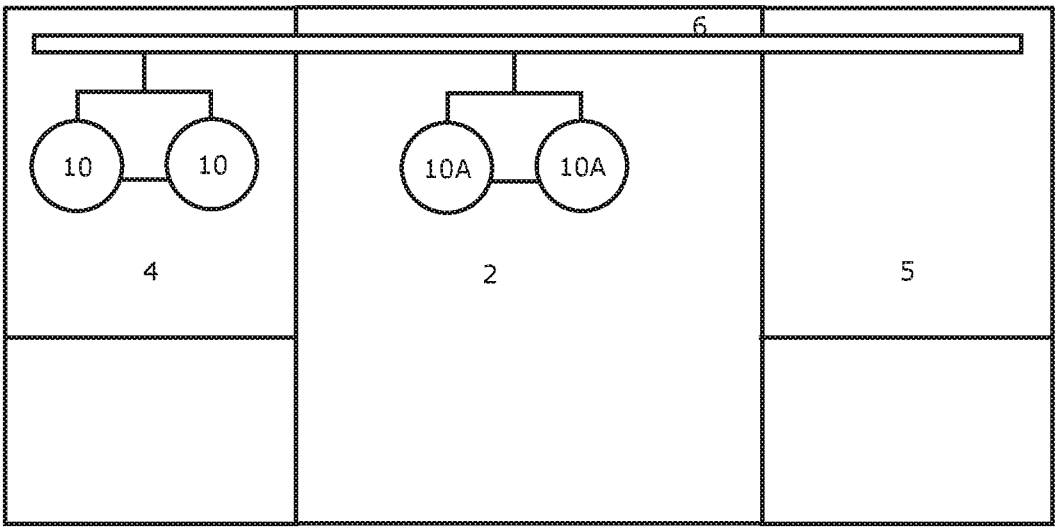

Once the first pair of wheels 10 have been sprayed, they are moved into the baking zone of one of the ovens, in this case the first oven 4 (FIG. 10). The upper door of the first oven 4 is opened and the frame carrying the wheels 10 is moved along the transport rail 6 so that the wheels 10 are located within the baking zone of the first oven 4. The upper door is then closed and the first oven can be operated to bake the wheels 10 at the appropriate temperature for the appropriate time.

Figure 12:
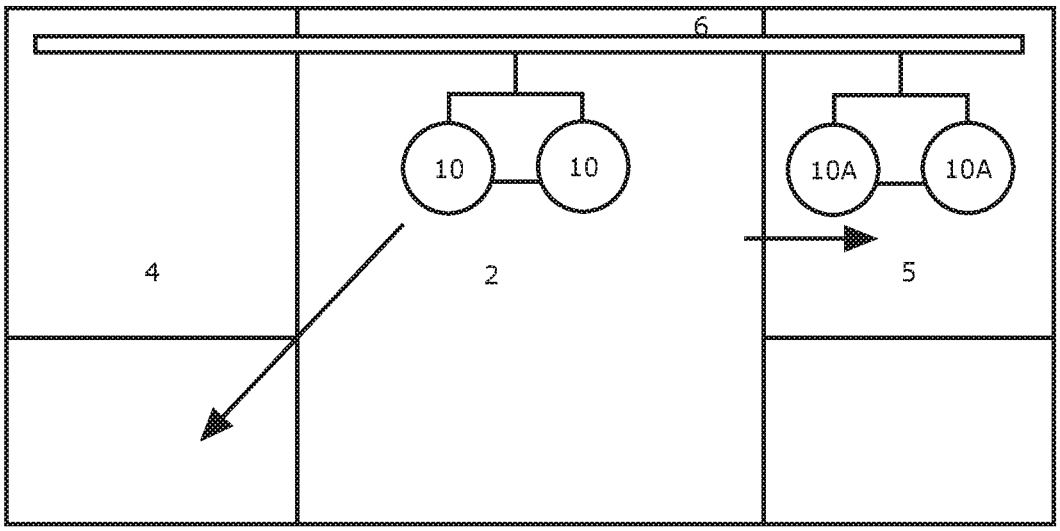

Now that the spraying zone 22 is free, a second pair of wheels 10A is loaded onto the transport rail 6 (FIG. 11) in the spraying zone 22 for spraying and processing by the operator. During this processing, the first pair of wheels 10 is being baked in the first oven 4. As such, the arrangement described enables different operations to be carried out in parallel with one another, thereby contributing to increased throughput and efficiency. Following completion of the spraying operation on the second pair of wheels 10A, those wheels are moved along the transport rail 6 into the baking zone of the second oven 5. The spraying zone 22 is then free, and the first pair of wheels 10 can be moved into that zone 22 when the baking operation in the first oven 4 is completed (FIG. 12).

Some finishing operations require a second spraying stage, and that can now be completed in the spraying zone 22 for the first pair of wheels 10. The first pair of wheels may then be returned to the oven 4 for a further baking stage. Alternatively, the first pair of wheels 10 may require curing in the curing zone of the first oven 4 (the curing zone of the second oven may be used), and so this first pair of wheels 10 is moved by the operator to that curing zone.

Figure 13:
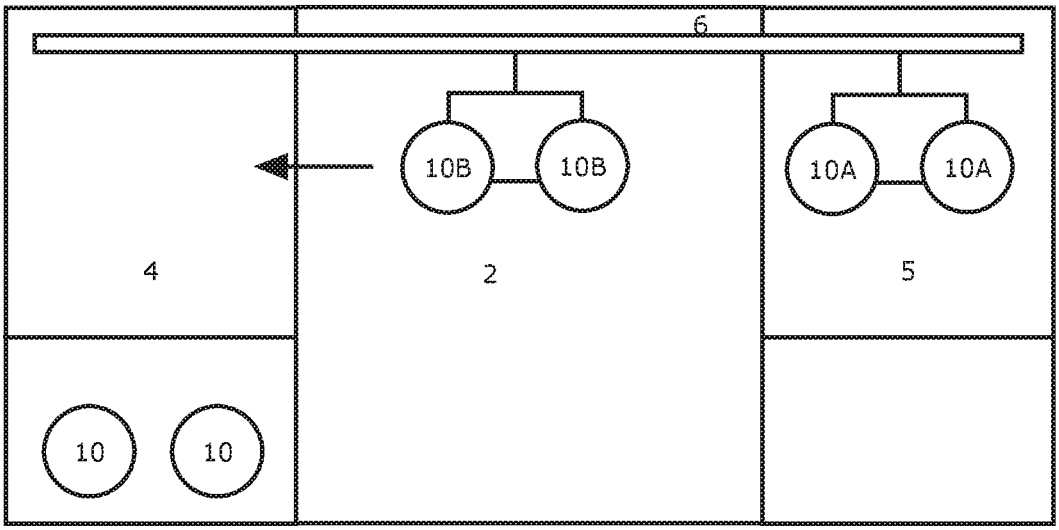
Figure 14:
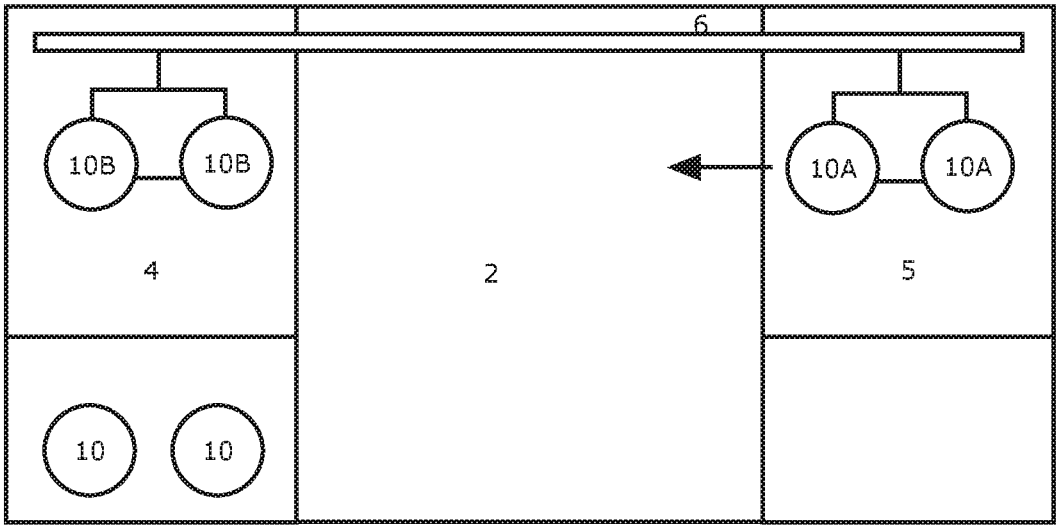

Once the first pair of wheels 10 has been moved out of the spraying zone 22 into the curing zone of the first oven 4, then the spraying zone 22 is again free for use. A third pair of wheels 10B may then be placed in the spraying zone 22 for processing while the second pair of wheels 10A are baked in the second oven 5. Such a situation is illustrated in FIG. 13. Following spraying, the third pair of wheels 10B are moved into the first oven for baking.

The second pair of wheels 10A can be removed from the second oven 5, and then handled appropriately, for example being placed in the curing zone, thereby enabling a further pair of wheels to be processed and baked.

As will be readily appreciated, the arrangement described above enables increases in efficiency in the processing of workpieces, such as wheels, by enabling the workpieces to be transported between processing locations easily, using the transport rail, and by enabling processing to be carried out in parallel. That is the baking and curing ovens are separate to the spraying zone, thereby enabling baking and curing to carry on in parallel with one another and with a spraying process on another workpiece.

The invention claimed is:

1. A workpiece processing arrangement comprising:

a spray booth defining a work space, and operable to provide a controlled environment for spraying of material;

a first oven located adjacent a first end of the work space, the first oven defining an internal zone, and being operable to heat that internal zone to a desired temperature;

a second oven located adjacent a second end of the work space, the second oven defining an internal zone, and being operable to heat that internal zone to a desired temperature; and a transport rail which extends from the internal zone of the first oven, through the work space of the spray booth into the internal zone of the second oven, the transport rail being transporting of a workpiece from the work space of the spray booth into the internal zone of each of the first and second ovens, and into the work space from the internal zone of each of the first and second ovens.

2. A workpiece processing arrangement comprising:

a spray booth defining a work space, and operable to provide a controlled environment for spraying of material;

a first oven located adjacent a first end of the work space, the first oven defining an internal zone, and being operable to heat that internal zone to a desired temperature;

a second oven located adjacent a second end of the work space, the second oven defining an internal zone, and being operable to heat that internal zone to a desired temperature; and a transport rail which extends from the internal zone of the first oven, through the work space of the spray booth into the internal zone of the second oven, the transport rail being transporting of a workpiece from the work space of the spray booth into the internal zone of each of the first and second ovens, and into the work space from the internal zone of each of the first and second ovens, wherein the spray booth comprises:

a roof portion;

a side portion which extends from the roof portion to a floor;

first and second end portions which extend from respective opposing ends of the roof portion to the floor, the roof portion, side portion and first and second end portions thereby defining the work space having a substantially closed side, a pair of substantially closed ends, and a side substantially open to the outside of the booth, the work space including a work zone in which an operative is located during use of the spray booth, and a spraying region in which a workpiece is located during spraying thereof;

air input equipment operable to provide an input airflow at an input volume flow rate into the work space via the roof portion; and air extraction equipment operable to extract airflow at an output volume flow rate from spraying the work space.

3. An arrangement as claimed in claim 2, wherein the input volume flow rate is greater than the output volume flow rate.

4. An arrangement as claimed in claim 2, wherein the input volume flow rate is at least twice the output volume flow rate.

5. An arrangement as claimed in claim 2, wherein the roof portion defines a plenum into which the airflow is supplied.

6. An arrangement as claimed in claim 2, wherein the air input equipment comprises a fan unit mounted on the roof portion.

7. An arrangement as claimed in claim 2, wherein the air extraction equipment comprises an extraction aperture located in the side portion, a fan unit located outside of the workspace, extraction ducting extending from the extraction aperture to the fan unit, and an extraction filter.

8. An arrangement as claimed in claim 2, wherein the air extraction equipment comprises an extraction aperture located in the side portion, a fan unit located outside of the workspace, extraction ducting extending from the extraction aperture to the fan unit, and an extraction filter, the arrangement further comprising an air outlet connected with the fan unit, and arranged for connection to an air outlet chimney.

9. An arrangement as claimed in claim 1, wherein the first oven defines a baking zone and a curing zone in the internal zone of the oven, the first oven being operable to heat the baking zone to a baking temperature, and to heat the curing zone to a curing temperature, the baking temperature being higher than the curing temperature.

10. An arrangement as claimed in claim 1, wherein the first oven defines a baking zone and a curing zone in the internal zone of the oven, the first oven being operable to heat the baking zone to a baking temperature, and to heat the curing zone to a curing temperature, the baking temperature being higher than the curing temperature, and wherein the baking zone is located above the curing zone.

11. An arrangement as claimed in claim 1, wherein the first oven defines a baking zone and a curing zone in the internal zone of the oven, the first oven being operable to heat the baking zone to a baking temperature, and to heat the curing zone to a curing temperature, the baking temperature being higher than the curing temperature, and wherein the first oven defines a first aperture for access into the baking zone, and a second aperture for access into the curing zone, the first and second apertures being provided with respective doors for selective closure thereof.

12. A method of processing a work piece in a workpiece processing arrangement comprising a spray booth defining a work space, and operable to provide a controlled environment for spraying of material, a first oven located adjacent a first end of the work space, the first oven defining an internal zone, and being operable to heat that internal zone to a desired temperature, a second oven located adjacent a second end of the work space, the second oven defining an internal zone, and being operable to heat that internal zone to a desired temperature, and a transport rail which extends from the internal zone of the first oven, through the work space of the spray booth into the internal zone of the second oven, the transport rail being adapted for transport of a workpiece from the work space of the spray booth to the internal zone of each of the first and second ovens, and into the work space from the internal zone of each of the first and second ovens, the method comprising:

a. locating a first workpiece in the spray booth;

b. performing an operation on the first workpiece;

c. moving the first workpiece to the internal zone of the first oven using the transport rail;

d. locating a second workpiece in the spray booth;

e. performing an operation on the second workpiece;

f. moving the second workpiece to the internal zone of the second oven using the transport rail;

g. moving the first workpiece from the first oven to the spray booth using the transport rail;

h. removing the first workpiece from the spray booth;

i. moving the second workpiece from the second oven to the spray booth using the transport rail; and j. removing the second workpiece from the spray booth.

13. A method as claimed in claim 12, comprising maintaining the internal zone of the first oven at a desired temperature when the first workpiece is located therein.

14. A method as claimed in claim 12, comprising maintaining the internal zone of the second oven at a desired temperature when the second workpiece is located therein.

15. A method as claimed in claim 12, wherein the first oven defines a baking zone and a curing zone in the internal zone of the oven, and wherein the method comprises heating the baking zone to a baking temperature, and heating the curing zone to a curing temperature, the baking temperature being higher than the curing temperature.

16. A method as claimed in claim 12, wherein the second oven defines a baking zone and a curing zone in the internal zone of the oven, and wherein the method comprises heating the baking zone to a baking temperature, and heating the curing zone to a curing temperature, the baking temperature being higher than the curing temperature.

17. A method as claimed in claim 12, wherein the second oven defines a baking zone and a curing zone in the internal zone of the oven, and wherein the method comprises heating the baking zone to a baking temperature, and heating the curing zone to a curing temperature, the baking temperature being higher than the curing temperature, and wherein the step of removing the first work piece from the spray booth comprises moving the first work piece to the curing zone of the first oven or to the curing zone of the second oven.

18. A method as claimed in claim 12, wherein the second oven defines a baking zone and a curing zone in the internal zone of the oven, and wherein the method comprises heating the baking zone to a baking temperature, and heating the curing zone to a curing temperature, the baking temperature being higher than the curing temperature, and wherein the step of removing the second work piece from the spray booth comprises moving the second work piece to the curing zone of the second oven or to the curing zone of the first oven higher than the curing temperature.

* * * * *